US009118142B2

(12) United States Patent
Nagasaki

(10) Patent No.: US 9,118,142 B2
(45) Date of Patent: Aug. 25, 2015

(54) CONNECTOR HAVING A LOCK WITH A LOCKING PROTRUSION ACTUATED BY A SLIDE MEMBER

(71) Applicant: Tyco Electronics Japan G.K., Kanagawa-ken (JP)

(72) Inventor: Taisuke Nagasaki, Kanagawa (JP)

(73) Assignee: Tyco Electronics Japan G.K., Kanagawa-ken (JP)

( * ) Notice: Subject to any disclaimer, the term of this patent is extended or adjusted under 35 U.S.C. 154(b) by 53 days.

(21) Appl. No.: 14/026,593

(22) Filed: Sep. 13, 2013

(65) Prior Publication Data

US 2014/0080348 A1 Mar. 20, 2014

(30) Foreign Application Priority Data

Sep. 14, 2012 (JP) ..... 2012-203263

(51) Int. Cl.
*H01R 13/627* (2006.01)
*H01R 13/62* (2006.01)

(52) U.S. Cl.
CPC ..... *H01R 13/62* (2013.01); *H01R 13/6273* (2013.01); *H01R 13/6275* (2013.01)

(58) Field of Classification Search
CPC ..... H01R 13/6171–13/6275
USPC ..... 439/352–358
See application file for complete search history.

(56) References Cited

U.S. PATENT DOCUMENTS

| | | | | |
|---|---|---|---|---|
| 5,436,744 | A * | 7/1995 | Arledge et al. | 349/150 |
| 5,634,809 | A * | 6/1997 | Hirai | 439/352 |
| 6,454,592 | B2 * | 9/2002 | Takagi | 439/378 |
| 7,801,003 | B2 * | 9/2010 | Kawaguchi | 369/53.23 |
| 7,857,652 | B2 * | 12/2010 | Amidon | 439/353 |
| 2009/0239405 | A1 | 9/2009 | Amidon | |
| 2009/0246999 | A1 | 10/2009 | Crofoot et al. | |

FOREIGN PATENT DOCUMENTS

| | | |
|---|---|---|
| EP | 1111728 A2 | 6/2001 |
| JP | 09-063694 | 3/1997 |
| JP | 2006-505113 | 2/2006 |
| JP | 2008-149597 | 7/2008 |
| JP | 2012-048901 | 3/2012 |
| WO | 2004-042877 | 5/2004 |

OTHER PUBLICATIONS

European Search Report, Application No. EP 13 18 3719.7, dated Sep. 24, 2014, 7 pages.

* cited by examiner

*Primary Examiner* — Chandrika Prasad
(74) *Attorney, Agent, or Firm* — Barley Snyder

(57) ABSTRACT

A connector including a housing. A lock is positioned on a mating end of the housing. The connector also includes a contact. A slide member is positioned on the housing and is slideable along a longitudinal axis to the mating end and engageable with the lock in a lock position, and being slideable along the longitudinal axis to a terminal end of the housing in an unlock position.

15 Claims, 25 Drawing Sheets

CONNECTOR HAVING A LOCK WITH A LOCKING PROTRUSION ACTUATED BY A SLIDE MEMBER

CROSS-REFERENCE TO RELATED APPLICATION

This application claims the benefit of the filing date under 35 U.S.C. §119(a)-(d) of Japanese Patent Application No. 2012-203263, filed Sep. 14, 2012.

FIELD OF THE INVENTION

The invention is generally related to a connector, and more specifically to an connector mateable with a mating connector for transferring a signal or electric power.

BACKGROUND

Conventionally, there are many types of connectors that transfer a signal and electric power. These connectors include a lock portion to lock the connector to a mating connector and to prevent unintentional disengagement of the connector from a mating connector.

For example, Japanese Patent No. H09-63694A illustrates a conventional connector which includes a lock portion and a slide plate to release the lock portion. Prior to the connector engaging with the mating connector, the lock portion is in a lock position. As the connector engages with the mating connector, the lock portion is deformed by the mating connector such that upon complete engagement, the lock portion is locked to the mating connector. To release the lock portion, the slide plate is operated, and the lock portion is deformed. While the lock portion is deformed, the mating connector can be disengaged. Upon disengagement, the slide plate returns to a starting position and the lock piece returns to the lock position.

Since the lock piece deforms upon engagement with the mating connector, the force required to mate the connector with the mating connector must be great enough to overcome both the insertion resistance of the connectors, and the resistance from the lock portion's deformation by the mating connector. For example, it is common for the connector to include many contacts or the connector to transfer high current. Consequently, the insertion resistance required to mate the connector with the mating connector can be very high, without factoring in the addition insertion resistance added by the lock portion being deformed. For this reason, when the insertion resistance is further added by the lock portion, the combined insertion resistance becomes so great that mating the connector to the mating connector can be difficult.

SUMMARY

In view of the foregoing problem, the present invention has been made to provide an connector including a lock that has a reduced insertion resistance.

A connector including a housing. A lock is positioned on a mating end of the housing. The connector also includes a contact. A slide member is positioned on the housing and is slideable along a longitudinal axis to the mating end and engageable with the lock in a lock position, and being slideable along the longitudinal axis to a terminal end of the housing in an unlock position.

DETAILED DESCRIPTION

An embodiment of the connector according to the present invention will be described with reference to the attached drawings in the followings.

Figure 1:
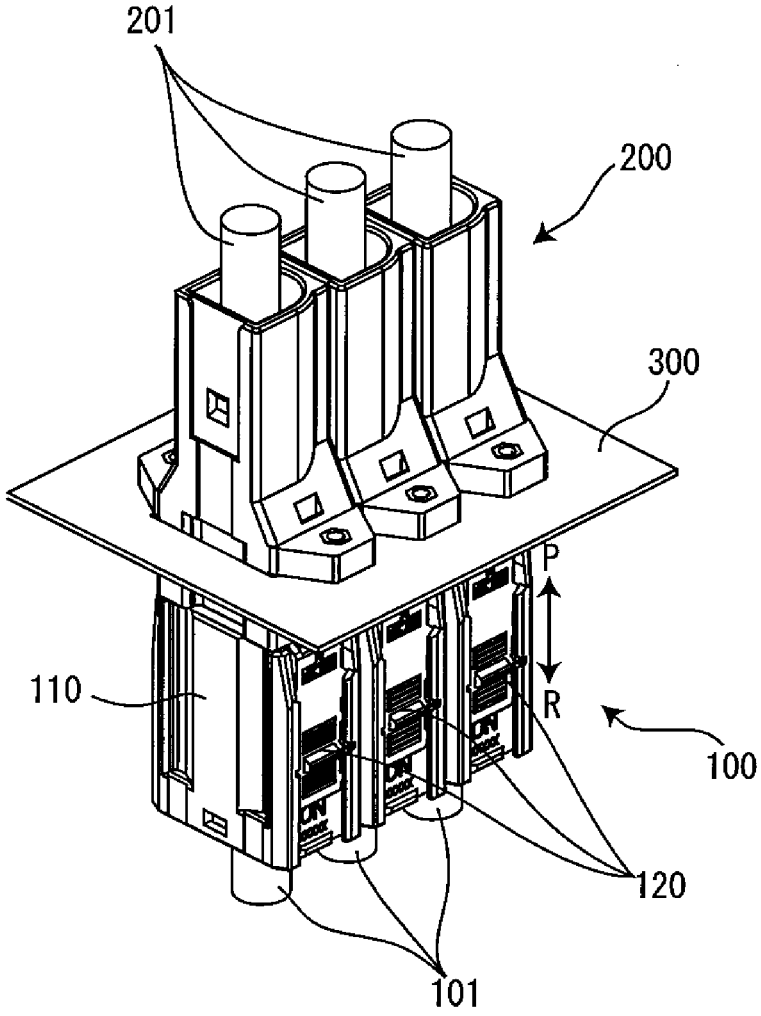
FIG. 1 is a perspective view illustrating a connector engaged with a mating connector.
Figure 2:
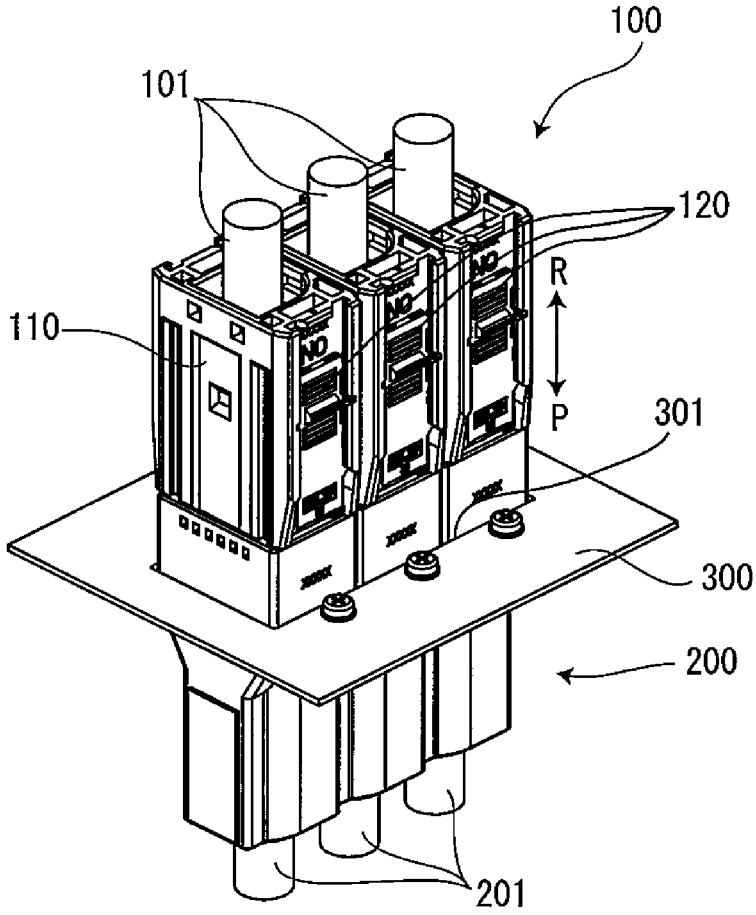
FIG. 2 is a perspective view viewed from a point different from that of FIG. 1 illustrating the connector engaged with the mating connector.

FIGS. 1 and 2 disclose three mating connectors 200 screwed to a support plate 300 formed with an opening 301 for engagement (see FIG. 2), and three connectors 100 engaged with the three mating connectors 200. The connectors 100 and the mating connectors 200 are connectors to transfer high electrical current, for example, of the order 300A, via connector cables 101 and mating connector cables 201.

The connector 100 includes slide members 120 which slide with respect to a connector housing 110 in a P-R direction illustrated in FIG. 2 on both side surfaces opposite to each other. The R side is a terminal end of the connector 100 and the P side is a mating end of the connector 100. When the slide members 120 are slid towards the terminal end R in the direction indicated by the arrow R, the connector 100 and the mating connector 200 are locked to each other for preventing disengagement. When the slide members 120 are slid towards the mating end P in the direction indicated by the arrow P, the lock is released so that the connector 100 can be disengaged from the mating connector 200.

Figure 3:
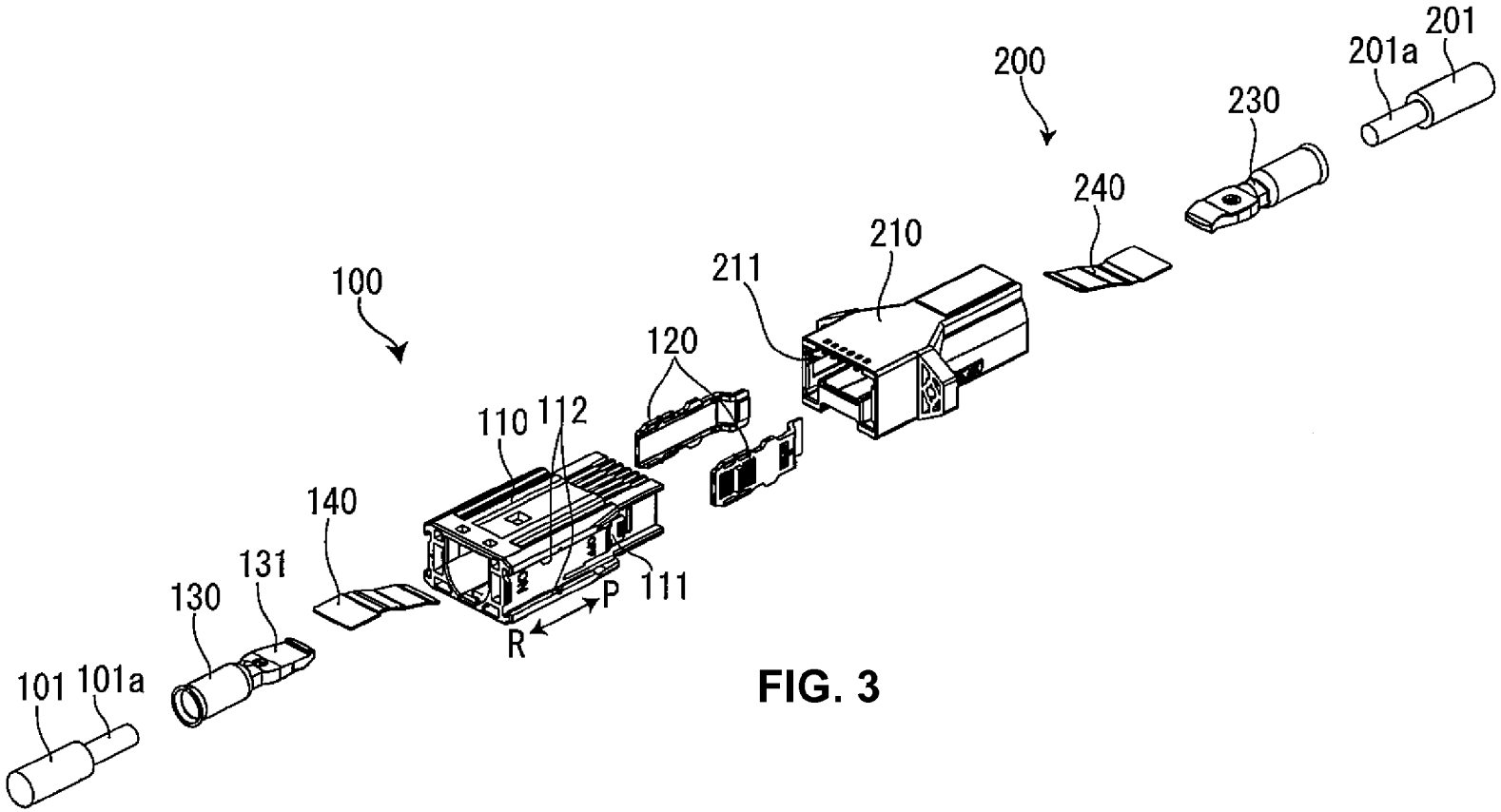
FIG. 3 is an exploded perspective view of the connector and the mating connector.
Figure 4:
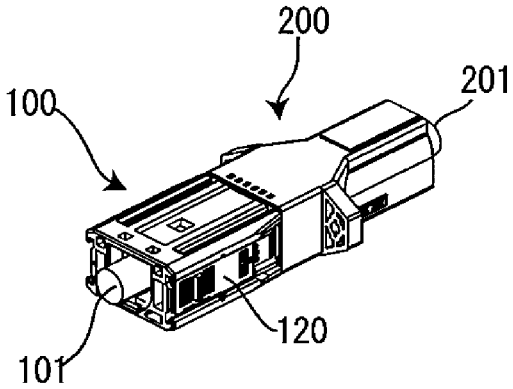
FIG. 4 is a perspective view illustrating the connector and the mating connector assembled and engaged with each other.

FIGS. 3 and 4 disclose the connector 100 having a connector contact 130 and a first leaf spring 140 in addition to the connector housing 110 and the slide members 120. A core wire 101*a* of the connector cable 101 is connected to a wire receiving end of the connector contact 130. The mating connector 200 includes a mating connector contact 230 and a second leaf spring 240 in addition to the mating connector housing 210. A core wire 201*a* of the mating connector cable 201 is connected to a wire receiving end of the mating connector contact 230.

Cantilevered locks 111 are provided on both side surfaces of the connector housing 110. These locks 111 engage with the mating connector housing 210 to lock the mating connector 200 to the connector 100 and prevent disengagement.

Slide members 120 are also provided on both of the side surfaces of the connector housing 110, and slide independently from each other along guide walls 112 disposed on both of the side surfaces of the connector housing 110.

When the slide members 120 slide toward the mating end P in the direction indicated by the arrow P, the slide members 120 engage a locking protrusion 111*a* disposed on a mating end of the lock 111 (see FIG. 10) to lock the connector 100 to the mating connector 200. When the slide members 120 slide toward the terminal end R in the direction indicated by the arrow R, the lock 111 is released and the mating connector 200 disengages from the connector 100. The slide members 120 are at a first position, when the slide members 120 have slid in the direction indicated by the arrow P to the mating end P of the connector housing 110, and are at a second position when the slide members 120 have slid in the direction indicated by the arrow R to the terminal end R of the connector housing. A force is applied to the sliding members 120 to effectuate the movement of the sliding members 120 and to disengage the lock 111.

The first leaf spring 140 abuts a first surface of a mating end 131 of the connector contact 130, located at an opposing end from the wire receiving end. A second surface of the mating end 131, located on an opposite side from the first surface, makes contact with a second surface of the mating end of the mating connector contact 230. The first leaf spring 140 applies a force on the connector contact 130 to press the second surface of the mating end 131 against the second surface of the mating end 231 when the connector 100 is engaged with the mating connector 200.

Similarly, the core wire 201*a* of the mating connector cable 201 is connected to a wire receiving end of the mating connector contact 230. The second leaf spring 240 abuts a first surface of the mating end 231 located at an opposing end from the wire receiving end. A second surface of the mating end 231 makes contact with the second surface of the mating end 131. The second leaf spring 240 applies a force on the mating connector contact 230 to press the second surface of the mating end 231 against the second surface of the mating end 131 when the mating connector 200 is engaged with the connector 100.

The mating connector housing 210 has a connector receiving passageway 211 disposed on a mating end of the mating connector housing 210.

Figure 5:
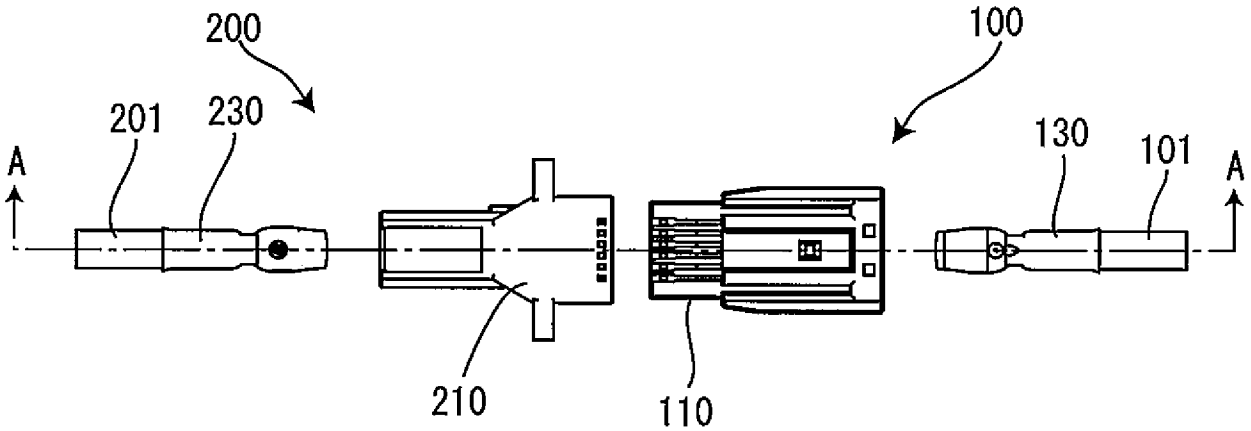
FIG. 5 is a plan view of the connector and the mating connector disengaged.
Figure 6:
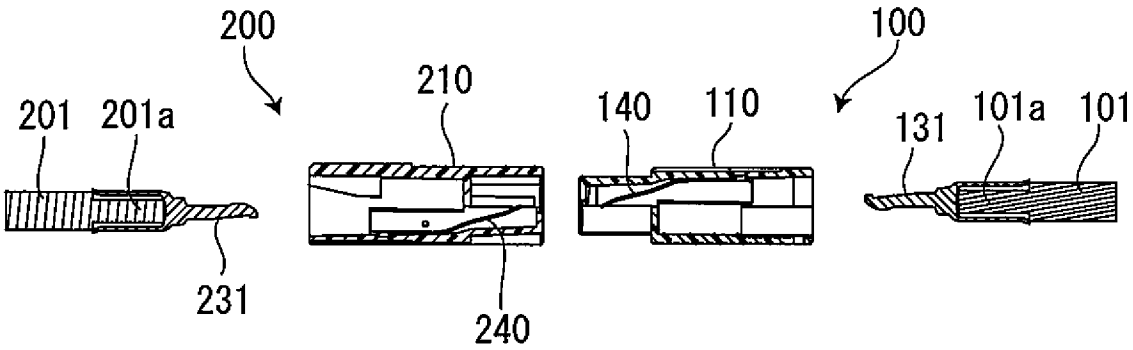
FIG. 6 is a sectional view taken along the line A-A illustrated in FIG. 5.
Figure 7:
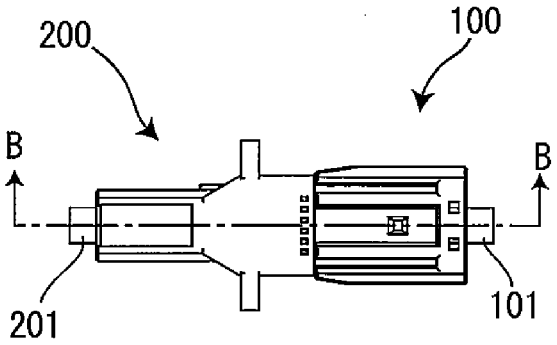
FIG. 7 is a plan view of the connector and the mating connector engaged.
Figure 8:
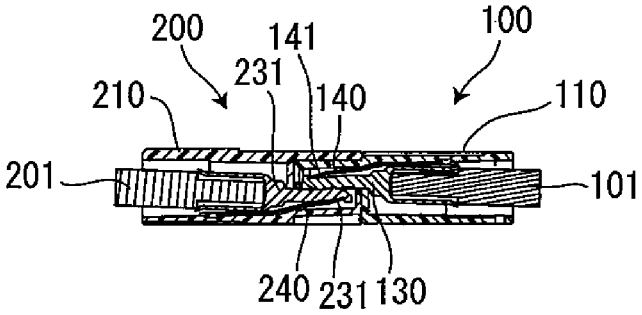
FIG. 8 is a sectional view taken along the line B-B illustrated in FIG. 7.
Figure 9:
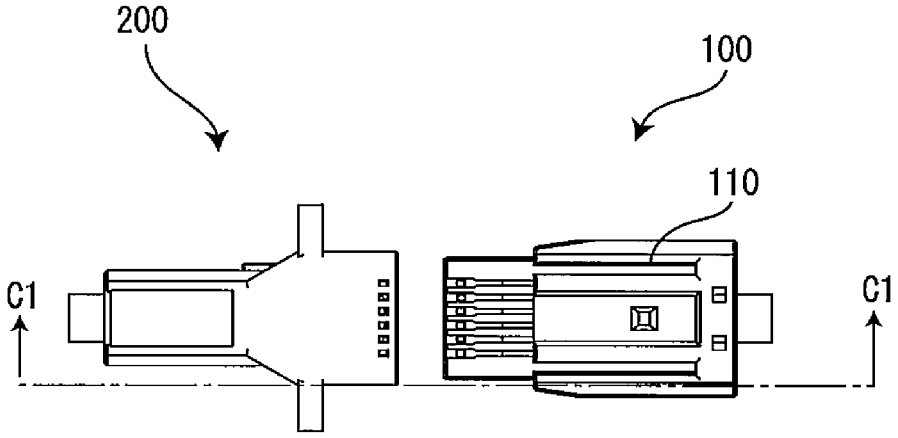
FIG. 9 is a plan view of the connector and the mating connector disengaged.

FIG. 5 illustrates the connector contact 130 connected to the connector cable 101, and the mating connector contact 230 connected to the mating connector cable 201, both being removed from the connector housing 110 and the mating connector housing 210.

The connector contact 130 and the mating connector contact 230 are arranged such that the first leaf spring 140 and second leaf spring 240 abut on the first surfaces of the mating ends 131, 231 opposite to the second surfaces of the mating ends 131,231. The second surfaces of the mating ends 131, 231 contact each other inside the connector housing 110 and mating connector housing 210.

When the connector 100 engages with the mating connector 200, the second surface of the connector contact 130 contacts the second surface of the mating connector contact 230. The connector contact 130 is displaced outward towards the first leaf spring 140. The mating connector contact 230 is displaced outward, in an opposite direction to the connector contact 130, towards the second leaf spring 240. The first leaf spring 140 and the second leaf spring 240 being abutted on the second surfaces of the connector contact 130 and the mating connector contact 230, respectively, are elastically deformed, and therefore apply a force to the contacts 130,230. Thus, the connector contact 130 and the mating connector contact 230 are pressed by the respective counterpart leaf springs 140, 240 to make contact with the contacts 230, 130 of the respective counterpart with a predetermined amount of force, and in addition, maintain contact with each other by the elasticity of the leaf springs even if receiving vibrations.

The cantilevered lock 111 is provided on the both side surfaces of the connector housing 110. A lock protrusion 111*a* to lock the connector 100 to the mating connector 200 is provided at the mating end tip of each of the lock 111.

In addition, a slide member 120 is provided on each of the side surfaces of the connector housing 110.

Figure 10:
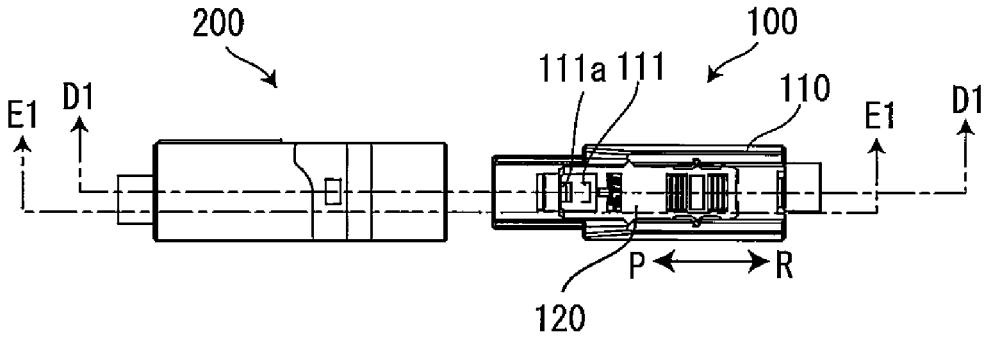
FIG. 10 is a side view of the connector and the mating connector disengaged.

The slide members 120 slide a longitudinal axis between the mating end and terminal end of the connector housing 110, in the direction indicated by the arrow P-R illustrated in FIG. 10. Each slide members 120 is positioned between a first and second guide wall 112 provided on each side surface of the connector housing 110.

Figure 11:
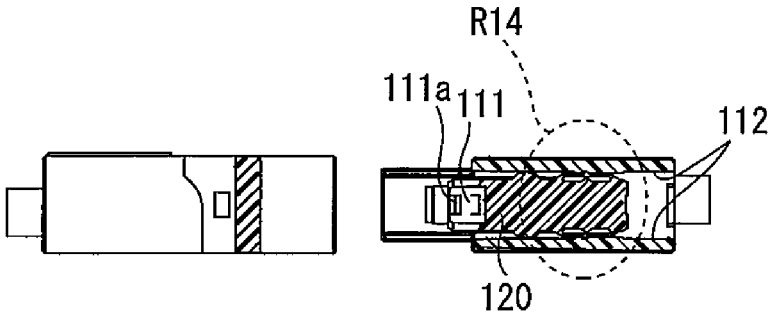
FIG. 11 is a sectional view taken along the line C1-C1 illustrated in FIG. 9.
Figure 12:
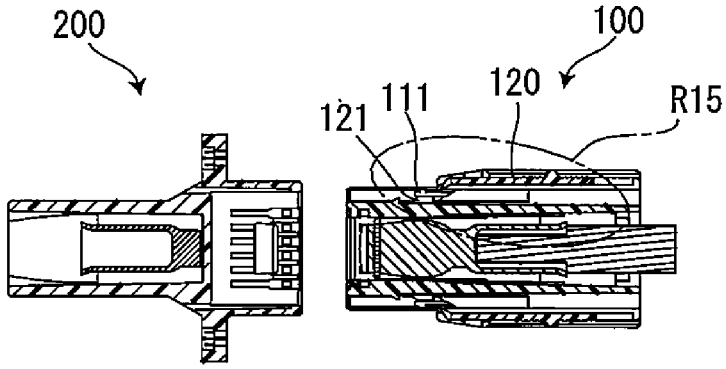
FIG. 12 is a sectional view taken along the line D1-D1 illustrated in FIG. 10.
Figure 13:
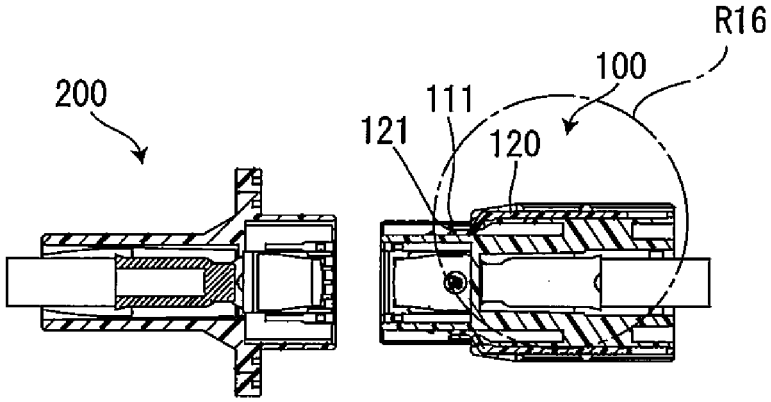
FIG. 13 is a sectional view taken along the line E1-E1 illustrated in FIG. 10.
Figure 14:
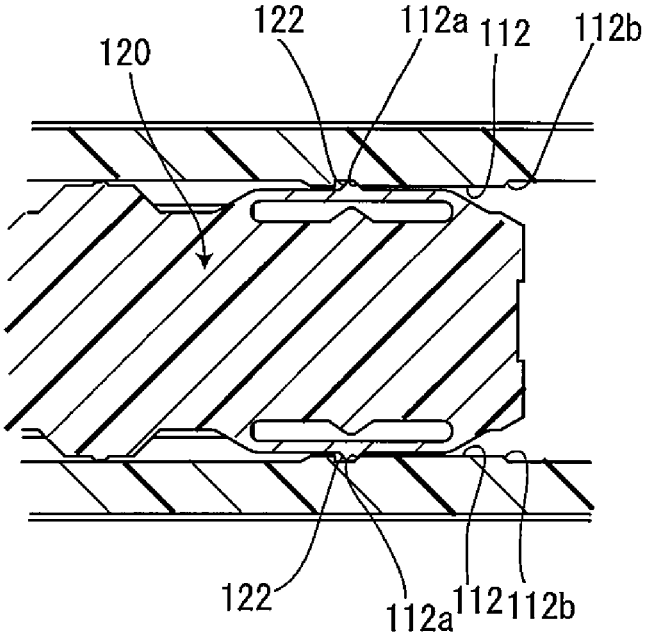
FIG. 14 is an enlarged view of a portion indicated by the circle R14 illustrated in FIG. 11.
Figure 15:
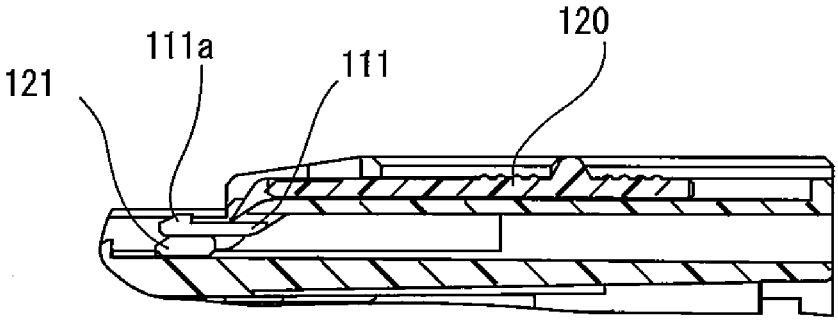
FIG. 15 is an enlarged view of a portion indicated by the circle R15 illustrated in FIG. 12.
Figure 16:
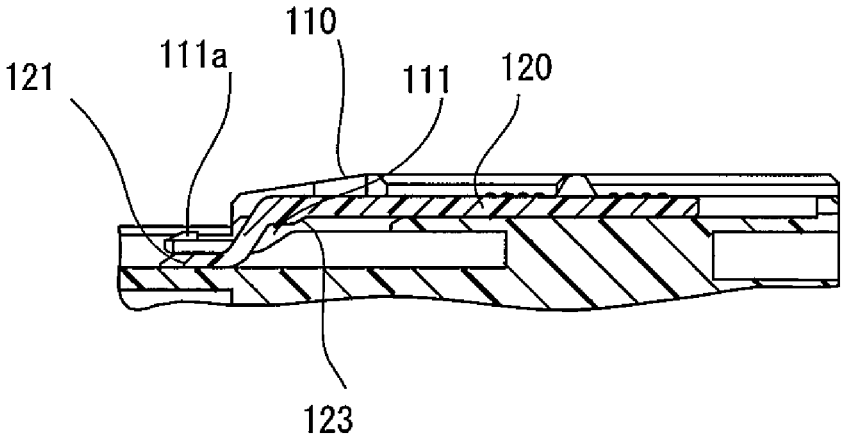
FIG. 16 is an enlarged view of a portion indicated by the circle R16 illustrated in FIG. 13.
Figure 17:
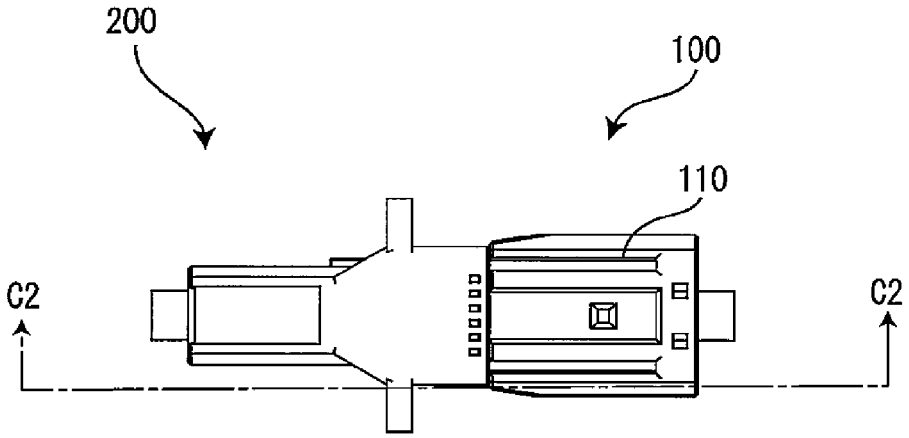
FIG. 17 is a plan view of the connector and the mating connector engaged.
Figure 18:
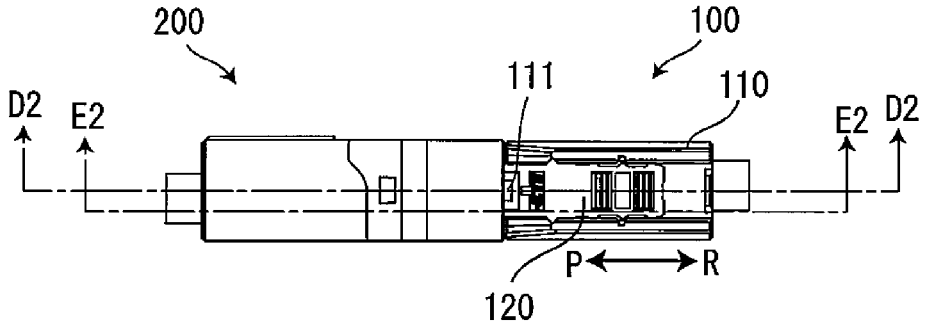
FIG. 18 is a side view of the connector and the mating connector engaged.
Figure 19:
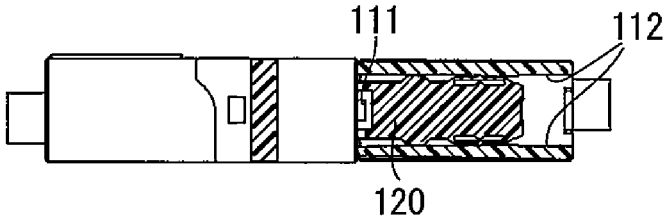
FIG. 19 is a sectional view taken along the line C2-C2 illustrated in FIG. 17.
Figure 20:
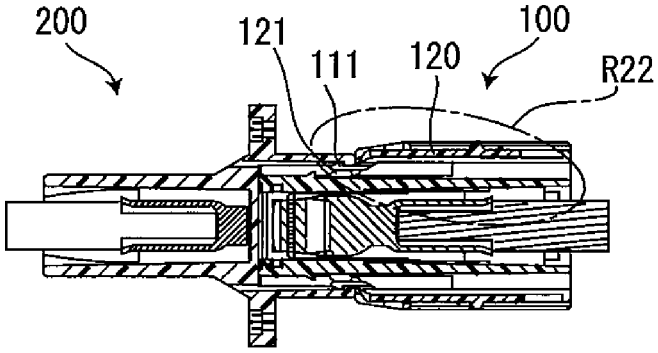
FIG. 20 is a sectional view taken along the line D2-D2 illustrated in FIG. 18.
Figure 21:
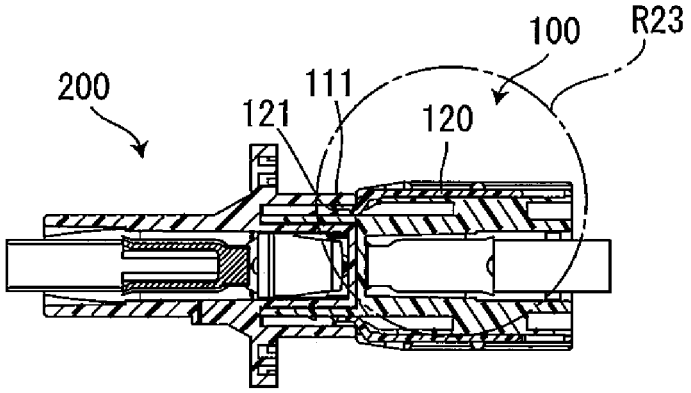
FIG. 21 is a sectional view taken along the line E2-E2 illustrated in FIG. 18.
Figure 22:
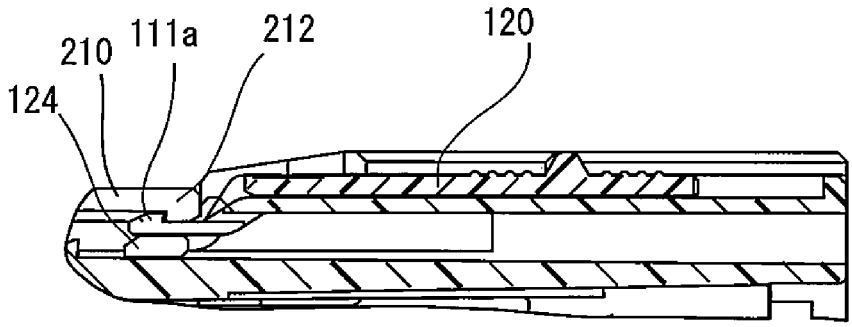
FIG. 22 is an enlarged view of a portion indicated by the circle R22 illustrated in FIG. 20.
Figure 23:
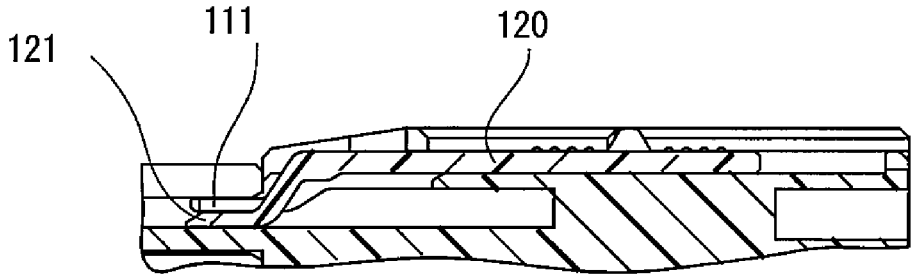
FIG. 23 is an enlarged view of a portion indicated by the circle R23 illustrated in FIG. 21.
Figure 24:
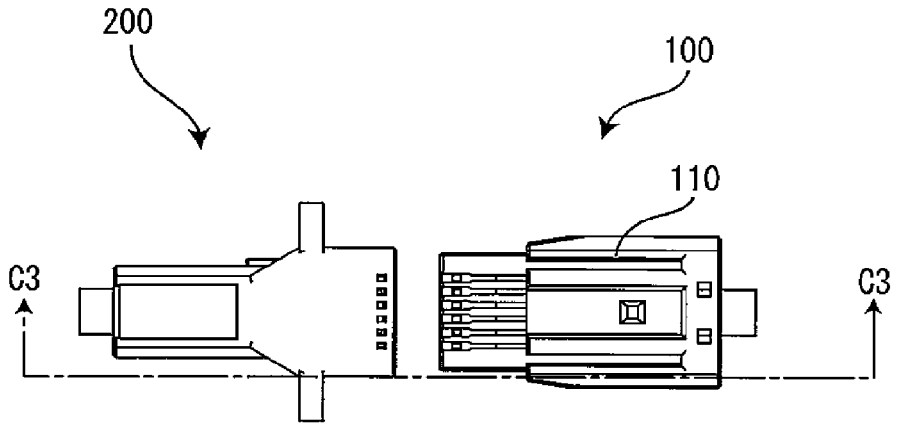
FIG. 24 is a plan view illustrating an unlocked and disengaged connector and mating connector.
Figure 25:
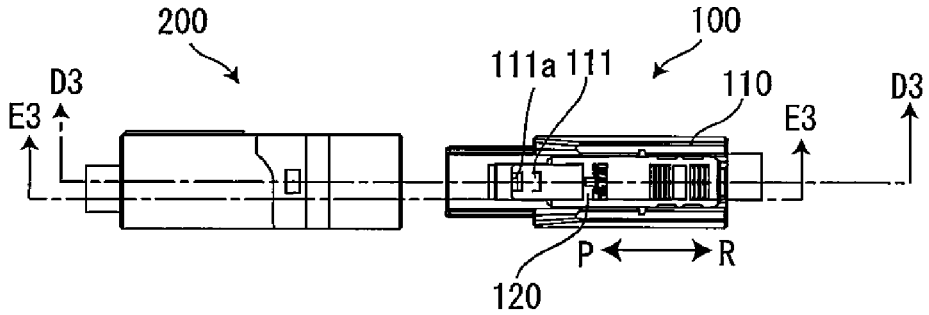
FIG. 25 is a side view of illustrating the unlocked and disengaged connector and mating connector.
Figure 26:
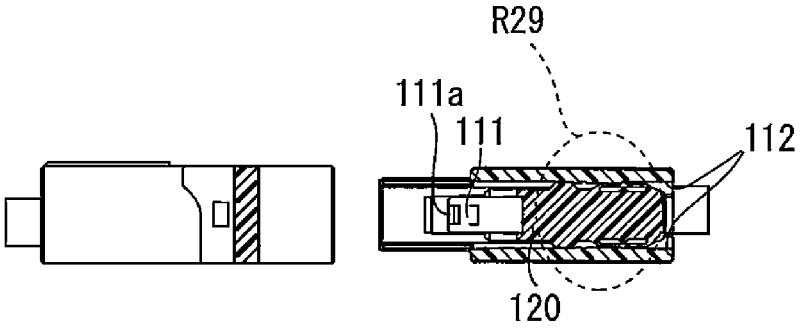
FIG. 26 is a sectional view taken along the line C3-C3 illustrated in FIG. 24.
Figure 27:
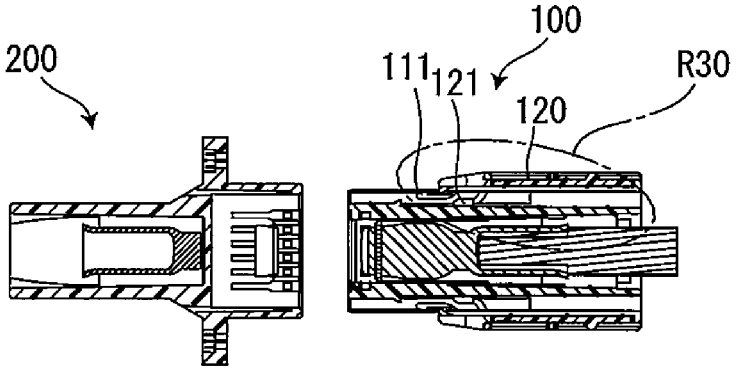
FIG. 27 is a sectional view taken along the line D3-D3 illustrated in FIG. 25.
Figure 28:
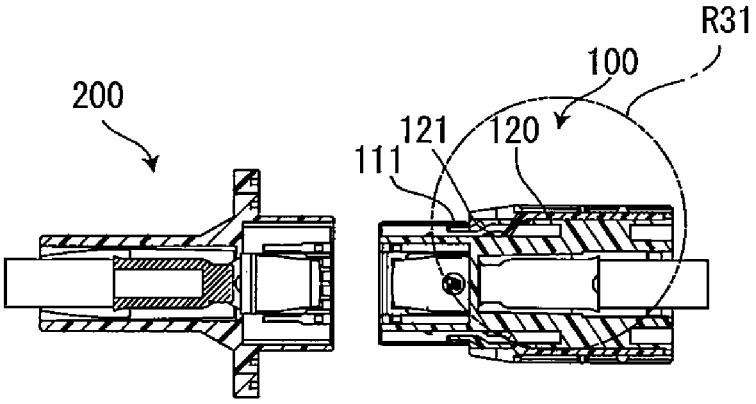
FIG. 28 a sectional view taken along the line E3-E3 illustrated in FIG. 25.
Figure 29:
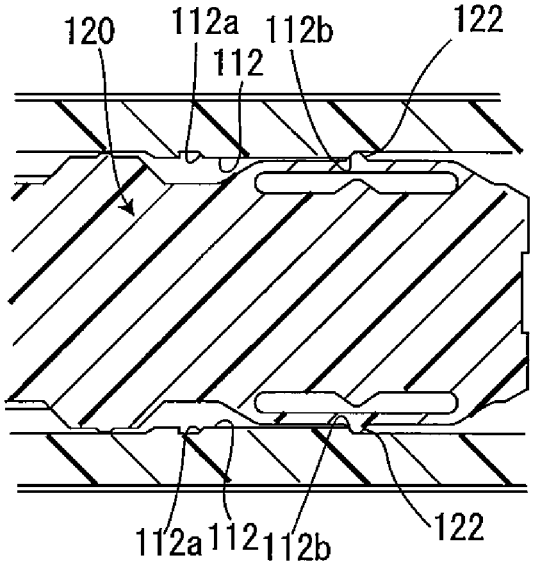
FIG. 29 is an enlarged view of a portion indicated by the circle R29 illustrated in FIG. 26.
Figure 30:
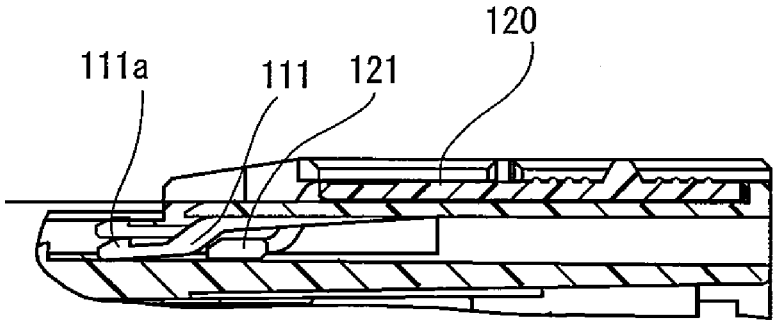
FIG. 30 is an enlarged view of a portion indicated by the circle R30 illustrated in FIG. 27.
Figure 31:
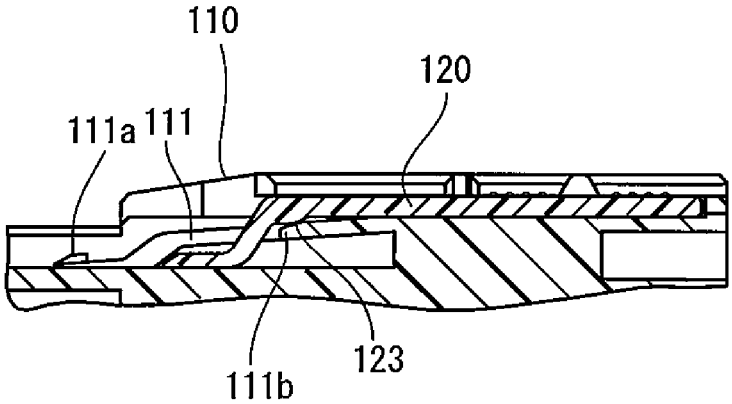
FIG. 31 is an enlarged view of a portion indicated by the circle R31 illustrated in FIG. 28.
Figure 32:
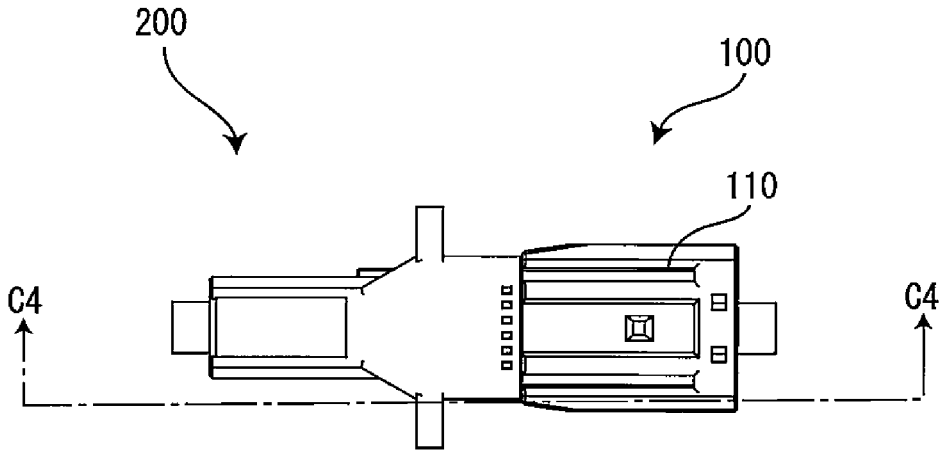
FIG. 32 is a plan view illustrating the unlocked and disengaged connector and mating connector.
Figure 33:
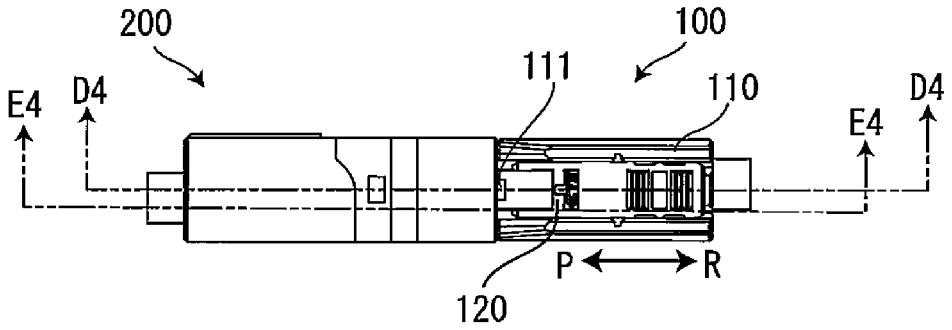
FIG. 33 is a side view of illustrating the unlocked and disengaged connector and mating connector.
Figure 34:
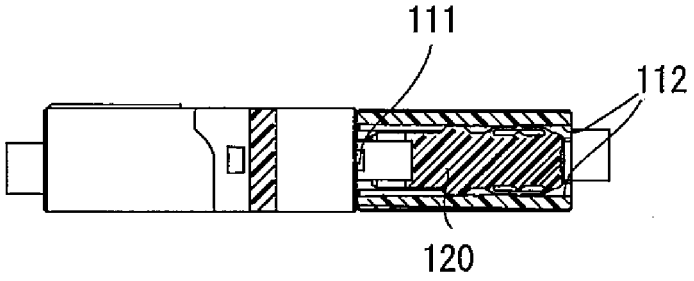
FIG. 34 is a sectional view taken along the line C4-C4 illustrated in FIG. 32.
Figure 35:
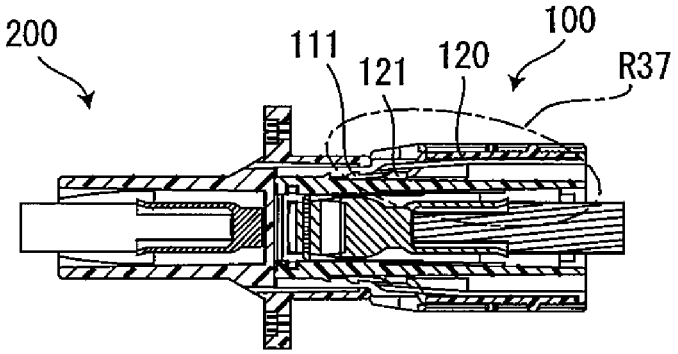
FIG. 35 is a sectional view taken along the line D4-D4 illustrated in FIG. 33.
Figure 36:
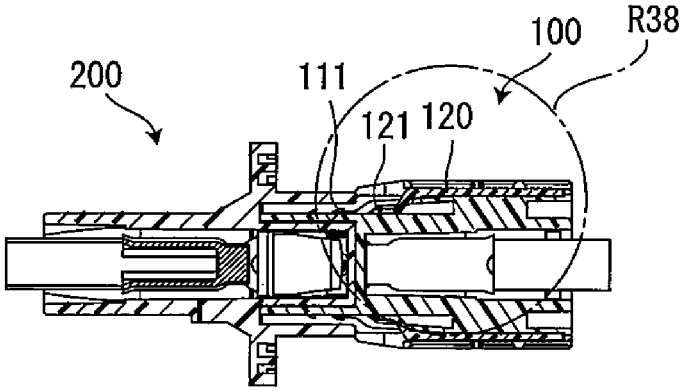
FIG. 36 is a sectional view taken along the line E4-E4 illustrated in FIG. 33.
Figure 37:
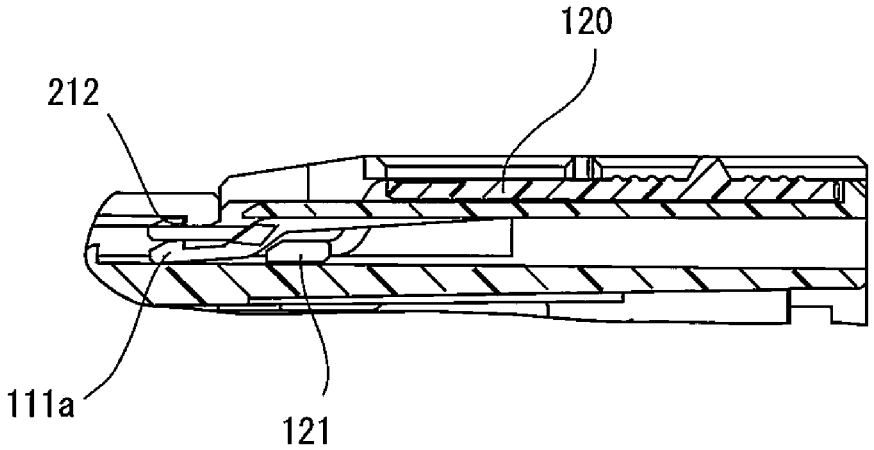
FIG. 37 is an enlarged view of a portion indicated by the circle R37 illustrated in FIG. 35.
Figure 38:
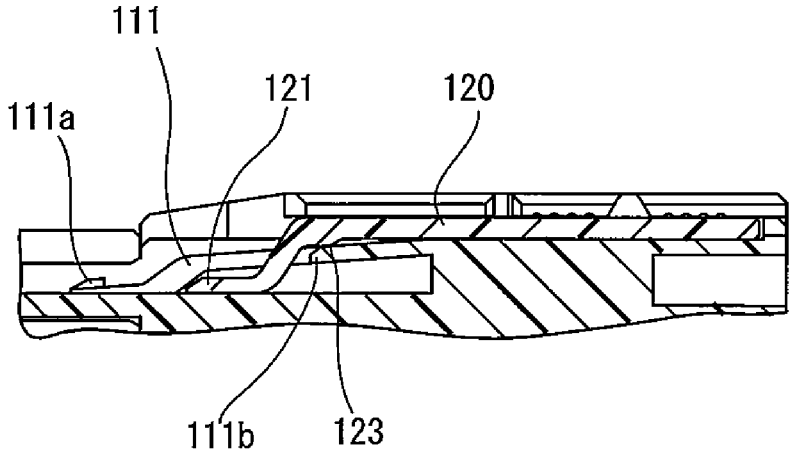
FIG. 38 is an enlarged view of a portion indicated by the circle R38 illustrated in FIG. 36.

As illustrated in FIGS. 11 and 14, a first and a second slide lock protrusion 122 is positioned on the slide member 120 and the first slide lock protrusion 122 projects toward the first guide wall 112 a and the second slide lock protrusion 122 projects toward the second guide wall 112. A first and a second lock depression 112*a* and a third and a fourth lock depressions 112*b* are positioned on each of the pair of guide walls 112. The first lock depression 112*a* and the third lock depression 112*b* are positioned on the first guide wall 112, with the first lock depression 112*a* being positioned towards the mating end P and the third lock depression 112*b* being positioned towards the terminal end R. The second lock depression 112*a* and the fourth lock depression 112*b* are positioned on the second guide wall 112, with the second lock depression 112*a* being positioned towards the mating end P, and the third lock depression 112*b* being positioned towards the terminal end R.

When the slide member 120 is positioned toward the mating end P in the direction indicated by the arrow P illustrated in FIG. 10, the first slide lock protrusion 122 is received into the first lock depression 112*a* and locked at that position. Additionally, the second slide lock protrusion 122 is received into the second lock depression 112*a* and locked at that position. FIGS. 9-23 illustrate the first and second lock protrusions 122 received into the lock depressions sections 112*a*.

When the first and second slide lock protrusions 122 are received into the first and second lock depressions 112*a*, a mating end tip 121 of the slide member 120 is positioned under the mating end tip of the lock 111 and displaces the lock protrusion 111*a* positioned on the mating end tip of the lock 111 in an upwards direction towards the first guide wall 112 (see FIGS. 15-16, FIGS. 22-23).

The lock protrusion 111*a* engages a mating lock protrusion 212 (see FIG. 22) positioned on an inner wall surface of the connector receiving passageway 211 (see FIG. 3) of the mating connector 200, and prevents the connector 100 from unintentionally being pulled out from the mating connector 200.

When the slide member 120 is positioned towards the mating end P and the first and second slide lock protrusions 122 are received into the first and second lock depressions 112*a*, the slide member 120 can slide towards the terminal end R in the direction indicated by the arrow R illustrated in FIG. 10. To effectuate this movement, a force larger than the locking force is applied to the slide member. As the slide member 120 slides towards the terminal end R, the first and second slide lock protrusions 122 disengage from the first and second lock depressions 112*a*. As the slide member 120 is slid towards the terminal end R in the direction indicated by the arrow R, the first slide lock protrusion 122 is received by the third lock depression 112*b* and the second slide lock protrusion 122 is received by the fourth lock depression 112*b* to lock the slide member 120 in a terminal end position. Consequently, the mating end tip 121 of the slide member 120 also slides toward the terminal end R, and the displaced mating end tip of the lock 111 returns outward towards the second guide wall 112, (see FIGS. 30-31, FIGS. 37-38). As the lock 111 returns outward, the lock protrusion 111*a* disengages from the mating lock protrusion 212 to unlock the connector 100 from the mating connector 200.

The cantilevered lock 111 further comprises an extension section 111*b* positioned along a midpoint between the mating end and the terminal end. The slide member 120 further comprises a cam projection 123 positioned on a mating end. When the slide member 120 is in a terminal end position, the cam projection 123 engages the extension section 111*b* (see FIG. 38) to displace the lock protrusion 111*a* further outward away from the mating lock protrusion 212. (see FIG. 37)

In other words, when the first and second slide lock protrusions 122 of the slide member 120 are received in the third and fourth lock depressions 112*b*, the lock protrusion 111*a* is forcibly retracted to a position in which the lock protrusion 111*a* does not contact the mating connector housing 210. Accordingly, the lock 111 does not contribute to an insertion resistance, and the engagement of the connector 100 and mating connector 200 can be performed by a smaller force.

In addition, after the connector 100 is engaged with the mating connector 200, the slide members 120 can slide towards the mating end into the lock position where the first and second slide lock protrusions 122 are received in the first and second lock depressions 112*a*. The connector 100 and the mating connector 200 are then securely locked together and prevented from being pulled out from each other.

Furthermore, the position of the lock protrusion 111*a* provides confirmation that the connector 100 has been fully inserted into the mating connector 200. If the connector 100 is partially inserted, then the slide member 120 is prevented from sliding completely towards the mating end because the lock protrusion 111*a* bumps against a portion other than the lock section 212. In other words, if the slide member 120 can slide completely to the mating end of the connector 100 into the lock position, complete engagement of the connector 100 with the mating connector 200 is confirmed. If the slide member 120 is prevented from sliding completely to the mating end of the connector 100, then incomplete engagement of the connector 100 with the mating connector 200 is confirmed.

It should be appreciated that while the detailed description was made in terms of the shown embodiments of the invention, the invention may pursue various modifications and add improvements, without being limited to the above disclosure.

In the descriptions above, a connector for transferring high electrical current is exemplified. However, one of ordinary skill in the pertinent art would appreciate that the present invention can also be widely applied to a connector for transferring a signal.

What is claimed is:

1. A connector comprising:
- a housing;
- a lock positioned on a mating end of the housing, and having
  - a mating end tip, and
  - a locking protrusion disposed on the mating end tip;
- a contact positioned in the housing; and
- a slide member positioned on the housing, having
  - a mating end tip, and
  - being slideable along a longitudinal axis to the mating end and engageable with the lock in a lock position, where the mating end tip of the slide member is positioned under the mating end tip of the lock and displaces the locking protrusion in an upwards direction, and
  - being slideable along the longitudinal axis to a terminal end of the housing in an unlock position.

2. The connector according to claim 1, wherein a pair of locks are positioned on the mating end of the housing.

3. The connector according to claim 2, wherein the pair of locks are each positioned on an opposing first surface and second surface of the housing.

4. The connector according to claim 1, wherein a pair of independently slideable slide members are positioned on the housing.

5. The connector according to claim 4, wherein the pair of slide members are each positioned on an opposing first surface and second surface of the housing.

6. The connector according to claim 1, wherein the slide member further comprises a cam projection positioned on a mating end.

7. The connector according to claim 6, wherein the lock further comprises an extension section positioned along a midpoint between a mating end and a terminal end, which is engageable with the cam projection when the slide member is in the unlock position.

8. The connector according to claim 1, wherein the lock is cantilevered on a terminal end of the housing.

9. The connector according to claim 1, wherein the housing further comprises a first guide wall and a second guide wall disposed on a side surface of the housing.

10. The connector according to claim 9, wherein the slide member is positioned between the first guide wall and the second guide wall.

11. The connector according to claim 10, wherein the slide member has a first slide lock protrusion and a second slide lock protrusion.

12. The connector according to claim 11, wherein the first guide wall has a first lock depression positioned towards the mating end of the housing and second guide wall has a second lock depression positioned towards the mating end of the housing.

13. The connector according to claim 12, wherein the first slide lock protrusion is received into the first lock depression and the second slide lock protrusion is received into the second lock depression in the lock position.

14. The connector according to claim 11, wherein the first guide wall has a third lock depression positioned towards the terminal end of the housing and the second guide wall has a fourth lock depression positioned towards the terminal end of the housing.

15. The connector according to claim 14, wherein the first slide lock protrusion is received into the third lock depression and the second slide lock protrusion is received into the fourth lock depression in the unlock position.

* * * * *